United States Patent [19]

Vetter et al.

[11] 4,171,220

[45] Oct. 16, 1979

[54] PHOTOGRAPHIC DYE DIFFUSION TRANSFER PROCESS

[75] Inventors: Hans Vetter, Cologne; Walter Püschel; Paul Marx, both of Leverkusen, all of Fed. Rep. of Germany

[73] Assignee: AGFA-Gevaert, A.G., Leverkusen, Fed. Rep. of Germany

[21] Appl. No.: 850,963

[22] Filed: Nov. 14, 1977

[30] Foreign Application Priority Data

Nov. 17, 1976 [DE] Fed. Rep. of Germany ..... 2652316

[51] Int. Cl.[2] ..... G03C 5/54; G03C 1/40; G03C 1/10

[52] U.S. Cl. ..... 96/29 D; 96/77; 96/99

[58] Field of Search ..... 96/29 D, 3, 77, 99

[56] References Cited

U.S. PATENT DOCUMENTS

| | | | |
|---|---|---|---|
| 3,931,144 | 1/1976 | Eldredge et al. | 96/29 D |
| 3,954,476 | 5/1976 | Krutak et al. | 96/29 D |

*Primary Examiner*—Richard L. Schilling

[57] ABSTRACT

Non-diffusible dye-providing compounds for the dye diffusion transfer process yielding color images of wanted absorption characteristics and improved light fastness correspond to the formula $$(A)_n-P-N=N-B-(A)_{1-n}$$

in which

A represents an oxidizable organic carrier residue which may be attached through a connecting member X and containing a group which confers diffusion resistance, from which carrier residue, either in its oxidized or in its unoxidized form, a part is split off together with the group which confers diffusion resistance under alkaline photographic development conditions, a diffusible azo dye represented by the formula P—N=N—B being released imagewise at the same time;

P represents a monocyclic, carbocyclic aromatic group;

B represents a bicyclic, carbocyclic aromatic group which carries a sulphonamide group in the p-position to the azo group;

n=0 or 1.

2 Claims, No Drawings

PHOTOGRAPHIC DYE DIFFUSION TRANSFER PROCESS

This invention relates to a process for the production of colour photographic images by the dye diffusion transfer process and to a suitable photographic material for this purpose, which material contains new diffusion-resistant, dye-providing compounds which release diffusible carbocyclic azo dyes.

Among the known processes for the production of colour photographic images by dye diffusion transfer, those based on the use of dye-providing compounds which are incorporated in a diffusion resistant form and fom which diffusible dyes or dye precursor products are split off in imagewise distribution during the development process to be transferred to an image receiving layer have recently become increasingly important.

Dye-providing compounds suitable for these processes include, for example, the non-diffusible colour couplers described in German Patent No. 1,095,115, which react with the oxidation product of a primary aromatic amine used as colour developer compound to release, in a diffusible form, either a preformed dye or a dye produced in the colour coupling reaction. The choice of developer compounds is, of course, in this case restricted to colour developers.

Reference should also be made in this connection to the non-diffusible dye-providing compounds described in German Offenlegungsschrift No. 1,930,215, in which a preformed, latently diffusible dye residue containing a group which confers diffusion resistance is attached through a hydrazone group which can be split. These compounds should not be regarded as colour couplers and it has, moreover, been found that the choice of developer compounds needed for releasing the diffusible dye residue is by no means restricted to the usual colour developers but may well be extended to black-and-white developers, for example pyrocatechols.

Non-diffusible coloured compounds have also been described in German Offenlegungsschrift No. 1,772,929. These compounds contain a special group and undergo a ring closure reaction during development to release a preformed dye residue in a diffusible form. The compounds described in this Offenlegungsschrift may be divided into two groups. The compounds of one group require a conventional colour developer compound for development. They couple with the oxidation product of this developer compound and subsequently undergo a ring closure reaction to release the preformed dye residue in a diffusible form. Compounds of the other group are themselves silver halide developers and are therefore capable, when in their oxidized form, of undergoing the above mentioned ring closure reaction to release the diffusible dyes even in the absence of other developer compounds.

Lastly, the non-diffusible dye-providing compounds described in German Offenlegungsschrift No. 2,242,762 should also be mentioned in this connection. These compounds are sulphonamido phenols and sulphonamido anilines which, after they have been oxidized by development, are decomposed under the influence of the developer alkali to release diffusible dyes which have a free sulphamoyl group.

All of the above mentioned dye-providing compounds function negatively, i.e. when conventional (negative) silver halide emulsions are used, the imagewise distribution of the diffusible dye released from these compounds corresponds with the negative silver image produced by development. To obtain positive dye images it is therefore necessary to use direct positive silver halide emulsions or to employ a suitable reversal process.

Non-diffusible dye-providing compounds disclosed in German Offenlegungsschriften Nos. 2,402,900 and 2,543,902 are capable of undergoing a splitting reaction under alkaline development conditions to release a diffusible dye, but, when they are in their oxidised form, this splitting reaction is difficult or impossible. Such compounds may be used in combination with conventional negative emulsions to produce positive transfer colour images.

Among the known dye-providing compounds, it is difficult to choose any which are satisfactory in every respect, both with regard to sufficient reactivity and with regard to sufficient stability. They should not already release the diffusible dyes at the very beginning of the alkaline development but only after imagewise oxidation has been effected by the silver halide which has been developed imagewise. On the other hand, release of the diffusible dyes either from the oxidized form of the dye-providing compounds or from their non-oxidized form, whatever the case may be, should proceed sufficiently rapidly and transfer of the diffusible dyes should also be rapid. It is very important that the dyes should be able to be fixed to a sufficient extent in the image receiving layer and, in addition, they must have excellent spectral properties and excellent stability to light and heat.

It has been observed that the dyes released from the known dye-providing compounds generally do not adhere sufficiently firmly to the mordant in the image receiving layer even after neutralisation. As a result of this, the edges of the image fade out and the sharpness of the image is severely reduced, especially in monosheet materials in which the image receiving sheet carrying the coloured image is not separated from the other, originally light-sensitive layers after transfer of the dyes. In extreme cases, the image obtained in the process may even disappear due to back diffusion. This is obviously undesirable.

It is therefore an object of this invention to provide new dye-providing compounds for the dye diffusion transfer process, in which the diffusible dyes released during photographic development are more firmly fixed to the mordants so that the stability and sharpness of the resulting colour transfer images can be improved. Furthermore, the dyes should provide good light-fastness.

The present invention relates to a photographic dye diffusion transfer process for the production of colour images in which a photographic material having at least one light-sensitive silver halide emulsion layer and a non-diffusible dye-providing compound associated with it is exposed imagewise and developed with a silver halide developer so that a diffusible dye is released imagewise from the non-diffusible dye-providing compound by the action of the developer alkali and transferred to the image receiving layer. The process is characterised in that the non-diffusible dye-providing compound used is a compound represented by the following formula I $$(A)_n—P—N{=}N—B—(A)_{1-n} \qquad \text{I}$$

in which

A represents an oxidizable organic carrier residue which may be attached through a connecting member X and containing a group which confers diffusion resistance, from which carrier residue, either in its oxidized or in its unoxidized form, a part is split off together with the group which confers diffusion resistance under alkaline photographic development conditions, a diffusible azo dye represented by the formula P—N=N—B in which either B or P is modified so as to carry along with it the remaining part of the original carrier residue being released imagewise at the same time;

P represents a monocyclic, carbocyclic aromatic group;

B represents a bicyclic, carbocyclic aromatic group which carries a sulphonamide group in the p-position to the azo group;

n=0 or 1

The dye-providing compounds according to the invention thus contain an azo dye residue of the formula P—N=N—B which is attached to a non-diffusible, oxidizable organic carrier residue either through the group P or through the group B. In the latter case the carrier residue may be attached to the bicyclic aromatic group either directly or through the sulphonamide group in p-position to the azo group. This carrier residue is such that, either in its oxidized or in its unoxidized form, it is split off from the dye-providing compounds under alkaline photographic development conditions e.g. by hydrolysis or by an intramolecular rearrangement reaction, so that a diffusible carbocyclic azo dye is released. Carrier residues A which have such functions are already known. As examples of such compounds may be mentioned, for example, the sulphonamidophenols and sulphonamidoanilines described in German Offenlegungsschrift No. 2,242,762 referred to above, which are split by the developer alkali after the oxidation reaction of development to release diffusible dyes which have a free sulphamoyl group. Other examples include the compounds described in German Offenlegungsschrift No. 2,505,248 (and the corresponding U.S. patent application Ser. No. 654,887, filed Feb. 2, 1976 and in our copending German Patent Application No. P 26 45 656.4 (and the corresponding U.S. patent application Ser. No. 839,374, filed Oct. 4, 1977, e.g. the 3-sulphonamidoindole compounds which, when in their oxidized form, are split in a similar manner by the developer alkali, thereby releasing diffusible dyes, carrying likewise a free sulphamoyl group. These compounds are therefore also able to effect a transfer of colour in the areas where development has taken place. German Offenlegungsschriften Nos. 2,402,900 and 2,543,902 should also be mentioned in this connection. Both of these Offenlegungsschriften described dye-providing compounds which undergo a splitting reaction under alkaline development conditions to release diffusible dyes from the non-oxidized form, but this splitting reaction is difficult or impossible, when the compounds are in their oxidized form. Compounds of this kind are therefore able to effect transfer of colour essentially only in those areas in which oxidation due to development has not taken place. They are therefore suitable for the production of positive transfer images.

Preferred compounds used according to the invention are represented by one of the following formulae:

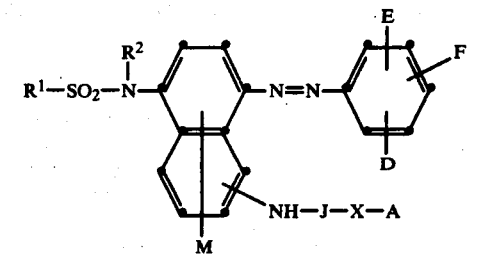

II

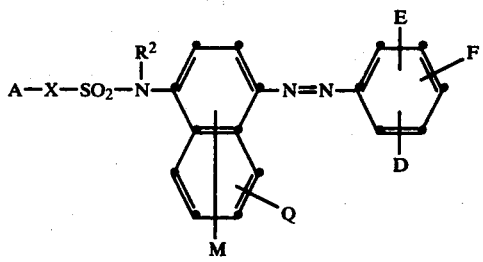

III

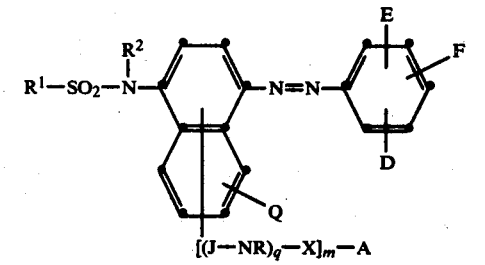

IV

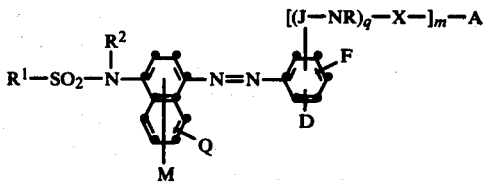

V in which

A represents an oxidizable organic carrier residue containing a group which confers diffusion resistance from which carrier residue, either in its oxidized or in its unoxidized form, a part thereof together with the group which confers diffusion resistance is split off under alkaline photographic development conditions, a diffusible azo dye having the general formula P—N=N—B in which either B or P is modified so as to carry along with it the remaining part of the original carrier residue, being released at the same time in imagewise distribution;

$R^1$ represents alkyl, preferably having from 1 to 6 carbon atoms, which may be substituted, for example, by a hydroxyl, cyano, sulphamoyl, carboxyl or sulpho group; or phenyl which may be substituted by halogen, cyano, alkyl, alkoxy or sulphamoyl;

$R^2$ represents hydrogen or a hydrolysable residue represented by the formula $$-\overset{O}{\overset{\|}{C}}-R^a$$

or by the formula $$-\overset{\overset{\displaystyle O}{\|}}{C}-OR^a$$

in which $R^a$ represents an alkyl group, preferably having from 1 to 18 carbon atoms or a substituted or unsubstituted phenyl group;

X represents a bivalent connecting member having the formula $-R^b-(Z)_x-(R^b)_y-$ in which $R^b$ represents an alkylene group, preferably having from 1 to 8 carbon atoms or a substituted or unsubstituted phenylene group, and the two groups $R^b$ may be the same or different;

Z represents —O—, —CO—, $-CONR^c-$, $-SO_2N-R^c-$, $-SO_2-$ or —SO— ($R^c$=hydrogen or alkyl);

x=0 or 1, y=0 or 1, and y=1 when x=1;

R represents hydrogen or an alkyl group preferably having up to 6 carbon atoms;

J represents a sulphonyl or carbonyl group;

m and q each represents 0 or 1;

Q represents an alkoxy group having from 1 to 6 carbon atoms or a hydroxyl group or a group represented by one of the formulae $-NHCOR^d$ or $-NHSO_2R^d$, in which $R^d$ represents a substituted or unsubstituted alkyl group, preferably having from 1 to 6 carbon atoms, for example an alkyl group substituted by a hydroxyl, cyano, sulphamoyl, carboxyl or sulpho group, or $R^d$ represents a benzyl or phenyl group, which phenyl group may be substituted, in particular by short chain substituents, and preferably together with its substituents has from 6 to 9 carbon atoms, i.e. $R^d$ may represent for example, a phenyl group substituted by a carboxyl, cyano, methoxy, methyl or sulphamoyl group, or a chlorine atom;

M represents hydrogen, halogen, sulpho or a sulphonic acid ester group, cyano, fluorosulphonyl, a substituted or unsubstituted alkyl sulphinyl group having from 1 to 8 carbon atoms, a phenyl sulphinyl group, a sulphamoyl group of the formula $-SO_2NR^eR^f$ or a carbamoyl group of the formula $-CON(R^e)_2$, where $R^e$ represents a hydrogen atom or an alkyl group having from 1 to 6 carbon atoms and two groups represented by $R^e$ may be the same or different from each other and $R^f$ represents a hydrogen atom, an alkyl group having from 1 to 6 carbon atoms, a benzyl group, a phenyl group, a substituted phenyl group having together with its substituents from 6 to 9 carbon atoms, and the total number of carbon atoms in $R^e$ and $R^f$ should not be higher than 14 and, moreover, $R^e$ and $R^f$ together with the nitrogen atom to which they are attached may form a morpholine or piperidine group; or M may represent an alkylcarbonyl group having from 2 to 8 carbon atoms or a phenyl carbonyl group having from 7 to 10 carbon atoms; a substituted or unsubstituted alkylsulphonyl group having from 1 to 8 carbon atoms or a substituted or unsubstituted phenylsulphonyl group having together with its substituents from 6 to 9 carbon atoms.

In the case of cyan dyes:

F represents the nitro group in the 4-position to the azo group;

D represents a halogen atom, a cyano, nitro or trifluoromethyl group or an alkyl group having from 1 to 6 carbon atoms, an alkoxy group having from 1 to 6 carbon atoms, a carboxyl group, a carboxylic acid ester group of the formula $-COOR^g$ (in which $R^g$ represents an alkyl group having from 1 to 18 carbon atoms or a substituted or unsubstituted phenyl group having together with its substituents from 6 to 18 carbon atoms, for example, a phenyl group substituted by a chlorine atom or a nitro group or an alkyl group having up to 12 carbon atoms), a fluorosulphonyl or trifluoromethylsulphonyl group, a sulpho or sulphonic acid ester group, a sulphamoyl group of the formula $-SO_2NR^eR^f$ or a carbamoyl group of the formula $-CON(R^e)_2$ in which $R^e$ has the meaning already specified and the two groups represented by $R^e$ may be the same or different from each other; or a substituted or unsubstituted alkylsulphonyl group having from 1 to 8 carbon atoms or a substituted or unsubstituted phenylsulphonyl group having together with its substituents from 6 to 9 carbon atoms;

E represents a hydrogen or halogen atom or a nitro, cyano, or trifluoromethyl group and D or $[(J-NR)_q-X\text{-}13]_mA$ of formula V and E are in the orthoposition to the azo group.

In the case of magenta dyes:

F represents a hydrogen atom or a substituted or unsubstituted alkyl group having from 1 to 4 carbon atoms or an alkoxy group having from 1 to 4 carbon atoms or a halogen atom; an electron attracting group, for example cyano, sulpho or sulphonic acid ester group, fluorosulphonyl, halogen, a substituted or unsubstituted alkylsulphonyl group having from 1 to 8 carbon atoms, a substituted or unsubstituted phenylsulphonyl group having together with its substituents from 6 to 9 carbon atoms, a substituted or unsubstituted alkylsulphinyl group having from 1 to 8 carbon atoms, a substituted or unsubstituted phenylsulphinyl group having together with its substituents from 6 to 9 carbon atoms, a sulphamoyl group of the formula $-SO_2-NR^eR^f$ or a carbamoyl group of the formula $-CON(R^e)_2$, in which $R^e$ and $R^f$ have the meanings already specified.

D and E the same or different represent hydrogen, cyano, trifluoromethyl, fluorosulphonyl, carboxyl or a carboxylic acid ester group of the formula $-COOR^g$, in which $R^g$ has the meaning already specified; or nitro in the 2- or 3-position to the azo group; fluorine, chlorine or bromine; a substituted or unsubstituted alkyl carboxyl group having from 2 to 7 carbon atoms; a substituted or unsubstituted phenyl carbonyl group having together with its substituents from 7 to 10 carbon atoms; or a substituted or unsubstituted alkylsulphonyl group having from 1 to 8 carbon atoms; a substituted or unsubstituted phenylsulphonyl group together with its substituents having from 6 to 9 carbon atoms; a sulphamoyl group of the formula $-SO_2NR^eR^f$ or a carbamoyl group of the formula $-CO\text{-}N(R^e)_2$ in which $R^e$ and $R^f$ have the meaning already specified.

It should be noted that the non-diffusible, oxidizable organic carrier residue may be attached either through the monocyclic aromatic ring such as in formula V or through the bicyclic aromatic ring, such as in formulae II–IV.

Particularly preferred compounds represented by the formulae I to V are those in which the group A is a group represented by one of the following formulae:

VI

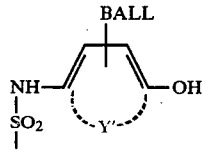

VII

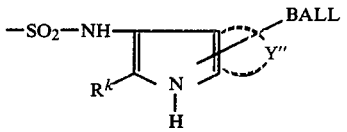

VIII

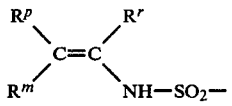

in which

BALL represents a ballasting group which confers diffusion resistance;

Y′ represents a group required for completing a benzene or naphthalene ring;

Y″ represents a group required for completing a condensed, substituted or unsubstituted benzene ring;

$R^k$ represents hydrogen, alkyl, aryl, a heterocyclic group, carboxyl, a substituted or unsubstituted carbamoyl group or an alkoxycarbonyl group;

$R^m$ represents $—OR^n$ or $—NHR^o$ in which $R^n$ represents hydrogen or a group which is capable of being hydrolysed under photographic development conditions, for example an acyl group derived from an aliphatic or aromatic carboxylic or sulphonic acid, including carbonic acid monoesters and carbamic acid; and $R^o$ represents hydrogen, alkyl, e.g. methyl, n-butyl or n-octadecyl, aryl, e.g. phenyl or naphthyl, or acyl, the acyl group being derived from an aliphatic or aromatic carboxylic acid or sulphonic acid, e.g. acetyl or p-toluenesulphonyl;

$R^p$ represents hydrogen, alkyl having up to 22 carbon atoms, such as methyl, n-butyl, isopropyl or n-octadecyl; aryl such as phenyl or o-carboxyphenyl; or-$NHR^q$, where $R^q$ represents an alkyl group, e.g. methyl; an aryl group, e.g. phenyl; or an acyl group, e.g. benzoyl or benzenesulphonyl;

$R^r$ represents hydrogen; alkyl having up to 22 carbon atoms, such as methyl, isopropyl, n-butyl or n-octadecyl; aryl, e.g. phenyl, carboxyphenyl or phenylaminophenyl; cyano; $—CO—NHR^s$ or $—CO—OR^s$, in which $R^s$ represents alkyl such as methyl or aryl such as phenyl.

In the preferred embodiment of the present invention, therefore, A represents, together with the attached $NH—SO_2$ group, a non-diffusible, oxidizable organic carrier residue, more specifically a carrier residue conforming to this definition which can only be decomposed by developer alkali when it is in its oxidized form. Dye diffusion therefore takes place only in those areas of the photographic material in which silver halide development occurs.

Where the carrier residue A contains a $—NH—SO_2$-group and is connected through it to the dye the dye-providing compound is split under alkaline development conditions to release a diffusible dye carrying along with it said $—NH—SO_2$-group whereas the carrier residue left behind does no longer contain said $—NH—SO_2$-group. Therefore in this case the diffusible dye is believed to be represented by the formula:

$$(NH_2—SO_2)_n—P—N=N—B—(SO_2—NH_2)_{1-n}$$

in which P, B and n have the meanings already specified above. Thus either B or P in fact is modified so as to carry along with it the remaining part ($—NH—SO_2—$) of the original carrier residue.

The bivalent connecting member represented in the general formulae II to V may be, for example, a group represented by one of the following formulae:

$—CH_2—CH_2—O—CH_2—CH_2—$ ,

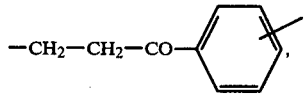

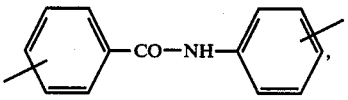

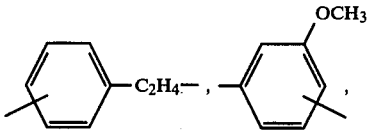

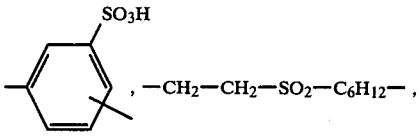

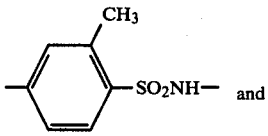

and $—C_3H_6—NH—CO—C_2H_4—$ .

It should be noted that when the dye-providing compounds according to the invention are present as intact molecules, they should not diffuse through the layers of the photographic material. For this purpose, they contain a group which confers diffusion resistance, for example, the ballasting group BALL.

The dye-providing compounds may have sufficient resistance to diffusion even when they do not contain long alkyl groups, since the molecule may be sufficiently large even under these conditions, depending on the size of the dye residue. In other cases, the dye-providing compounds may be rendered resistant to diffusion by using sufficiently large groups for conferring diffusion resistance.

Groups which confer diffusion resistance are groups which make it possible for the compounds according to the invention to be incorporated in a diffusion resistant form in the hydrophilic colloids normally used in photographic materials. Organic groups generally having straight or branched chain aliphatic groups and which may optionally also contain isocyclic or heterocyclic or aromatic groups, generally having from 8 to 20 carbon atoms are particularly suitable for this purpose. These groups are attached to the remainder of the molecule either directly or indirectly, e.g. through one of the following groups: —NHCO—; —NHSO$_2$—, —NR—, in which R represents hydrogen or alkyl; —O— or —S—. The group which confers diffusion resistance may in addition contain groups which confer solubility in water, e.g. sulpho groups or carboxyl groups, and these may also be present in an anionic form. Since the diffusion properties depend on the size of the molecule as a whole, it is in some cases sufficient, for example if the whole molecule is large enough, to use relatively short chain groups for conferring diffusion resistance.

Examples of suitable dye-providing compounds according to the present invention are given below. In all instances, instead of the organic carrier residue given in the following formulae other organic carrier residues may be used such as for example the following $A^x$, $A^y$ and $A^z$:

$A^x$ =

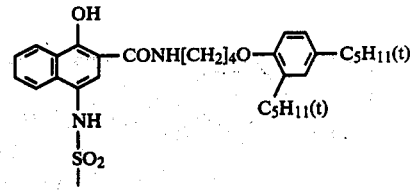

$A^y$ =

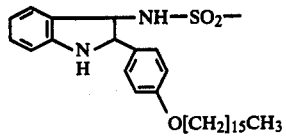

$A^x$ =

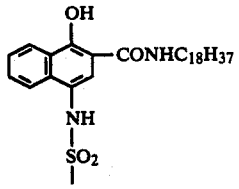

Examples of cyan-forming dye-providing compounds:

(1)

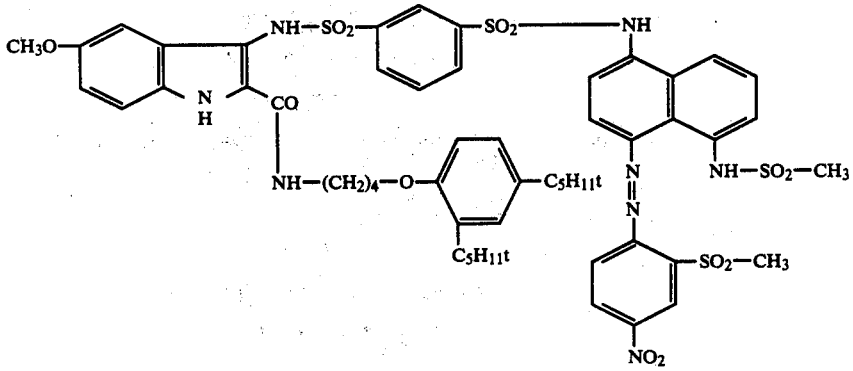

(2)

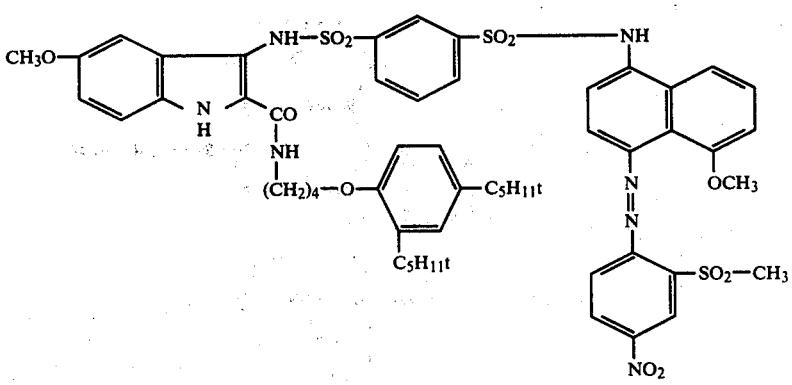

-continued
(3)
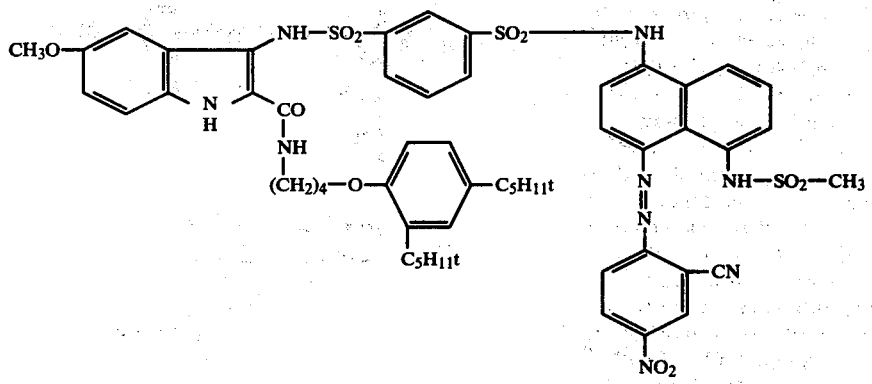
Examples of magenta-forming dye-providing compounds:
(4)
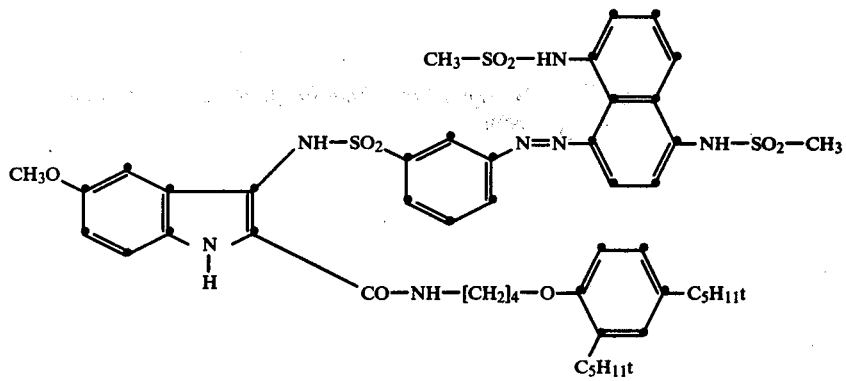
(5)
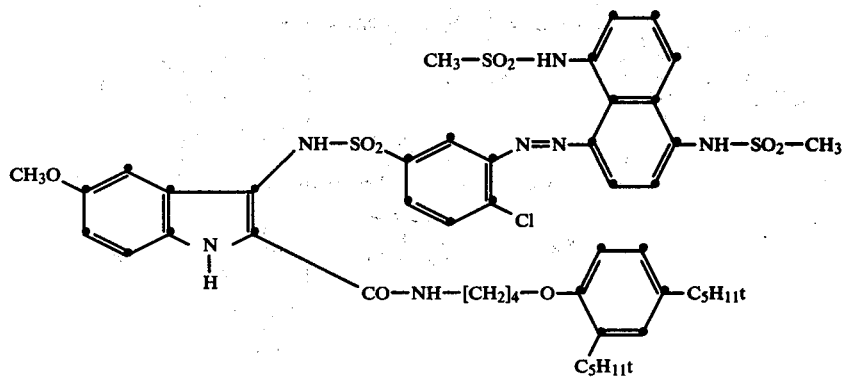
(6)
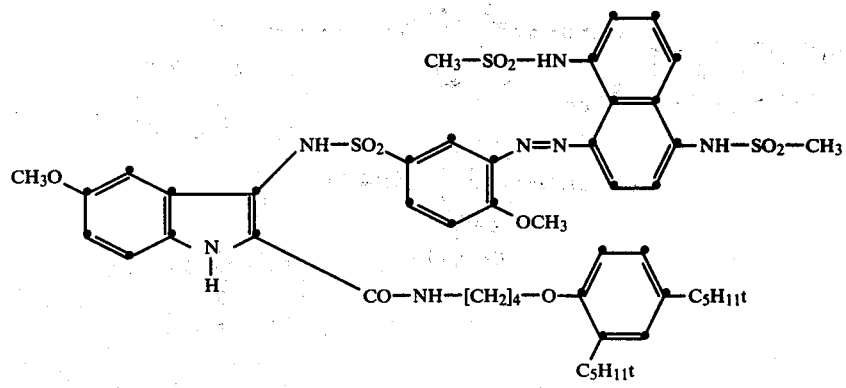

-continued
(7)
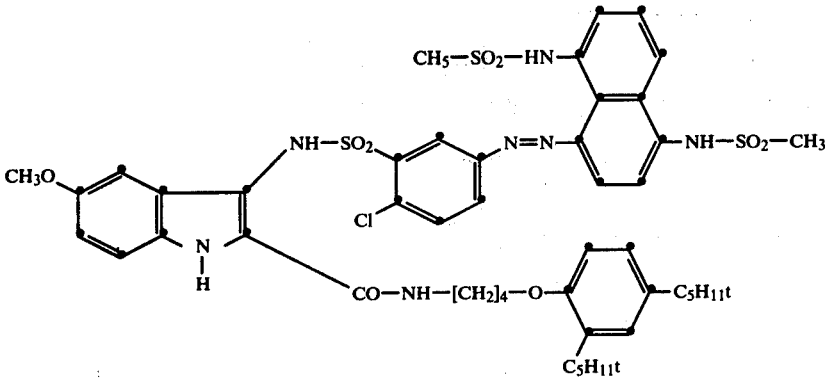
(8)
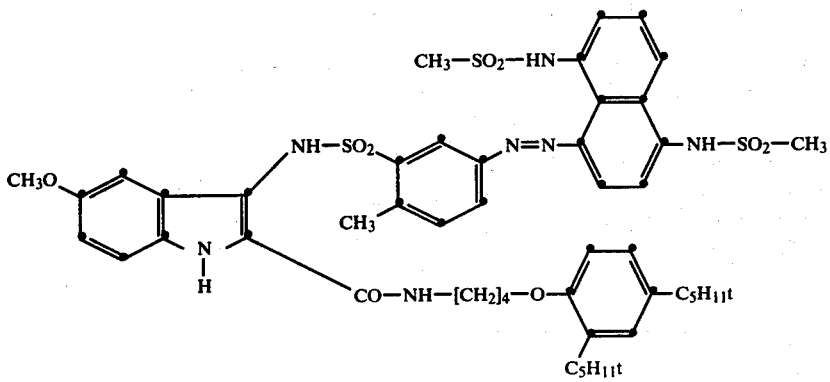
(9)
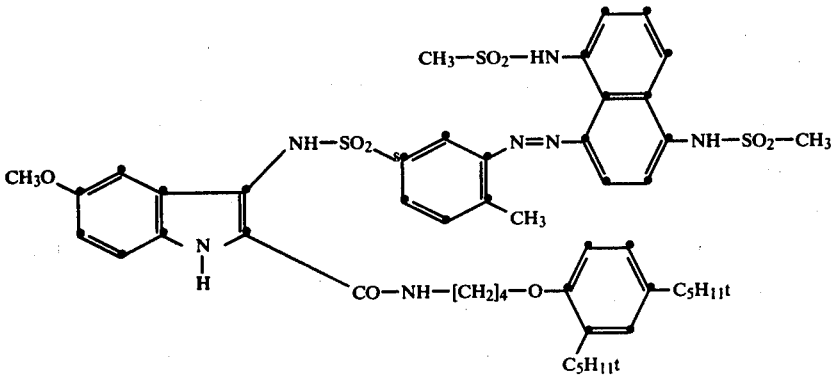
(10)
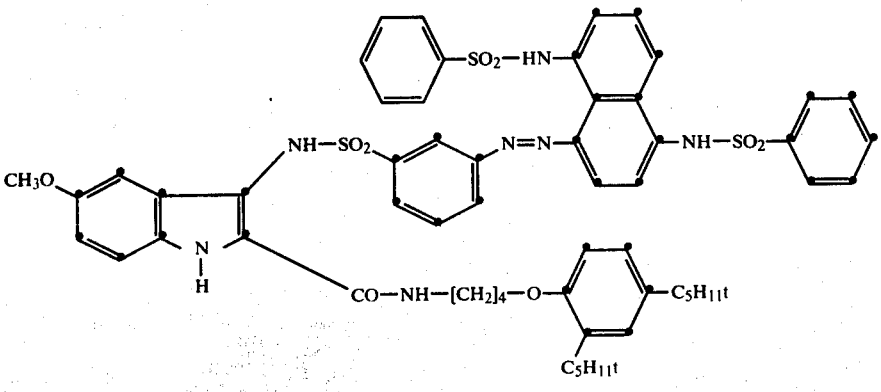

-continued (11)

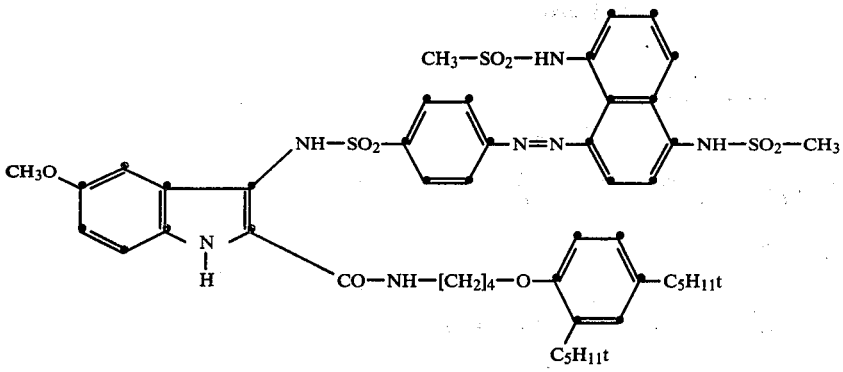

The dye-providing compounds according to the invention are generally prepared from a suitably substituted aniline corresponding to the residue P in the general formula I. This aniline is diazotised and coupled with a suitably substituted naphthalene derivative. The resulting azo dye may be used, for example, to prepare a sulphochloride derivative by known methods. This sulphochloride derivative is then reacted with the amino group of a suitable carrier residue which is capable of being oxidised. Methods of preparing the dye moiety of compounds 1, 3 and 4 are described in detail below. The other dye-providing compounds according to the present invention may be prepared in a similar manner.

Preparation of dye-providing compound No. 3

8 g of dye sulphochloride of formula A

A

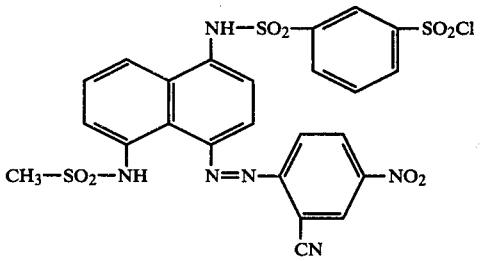

and 2,5 ml of pyridine are added with stirring to a solution of 4,4 g of the aminoindole B

B

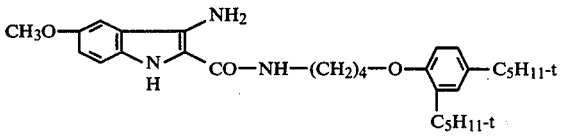

(can be prepared according to a method described in our copending German Patent Application P 26 45 656.4 and the corresponding U.S. application Ser. No. 839,374, filed Oct. 4, 1977) in 50 ml of chloroform and the stirring is continued for 1 hour. After addition of 100 ml of methanol the reaction mixture is heated to boiling, then cooled and the precipitated dye is suction filtered and washed with methanol. The residue is dissolved in 75 ml of hot chloroform, mixed with 75 ml of methanol, heated to boiling and cooled and the precipitated dye is collected, washed with methanol and dried.
Yield: 4,8 g of dye-providing compound No. 3.

The dye sulphochloride A was prepared as follows:

2.4 g of 2-amino-5-nitro-benzonitrile were mixed with 10 ml of acetic acid, and 2.5 ml of nitrosylsulphuric acid were added dropwise at a temperature below 15° C. and stirring is continued for 30 minutes. This mixture is added dropwise within 40 minutes at 5° C. to a mixture obtained by adding with stirring 7.3 g of 1-methanesulphonylamino-5-(3-fluorosulphonyl-benzenesulphonylamino)-naphthaline to 75 ml of 1 N sodium hydroxide solution and continuing the stirring for 30 minutes. The pH of the solution is kept at 9 to 10 by adding sodium hydroxide solution. After continuing the stirring for 3½ hours at pH 10 the precipitated dye is suction filtered, washed with 5% sodium chloride solution and dried.
Yield: 3.4 g of dye C.

C

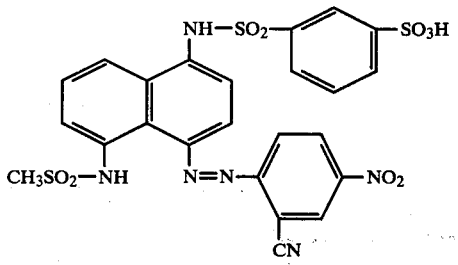

10 g of dye C were mixed with 30 ml of phosphoroxichloride, 1 ml of dimethylformamide were added below 15° C. and the mixture was stirred for 3 hours. After addition of 60 ml of chloroform stirring was continued for 5 hours; the precipitate was suction filtered, washed with 45 ml of chloroform and dried.
Yield: 5.3 g of dye sulphochloride A.

1-methanesulphonylamino-5-(3-fluorosulphonyl-benzolsulfonylamino)-naphthalene (used for the preparation of C) was prepared as follows:

8 g of methanesulphonylchloride were added dropwise within 30 minutes to a solution of 17.2 g of 1-amino-5-(3-fluorosulphonyl-benzenesulphonylamino)-naphthalene in 86 ml of acetone. After 2 hours' stirring the solution was mixed with 172 ml of water. The precipitate was suction filtered, washed with water and dried.
Yield: 20 g.

1-amino-5-(3-fluorosulphonyl-benzenesulphonylamino)-naphthalene was prepared by reacting 1,5-diaminonaphthalene with 3-fluorosulphonyl-benzenesulphochloride in the presence of acetone as solvent and pyridine as acceptor for hydrochloride.

The dye providing compounds No. 1 and 2 can be prepared in a similar way.

Preparation of dye-providing compound No. 4

4.4 g of 3-aminoindole represented by the formula B and 4.6 g of the dye-sulphochloride represented by formula D

D

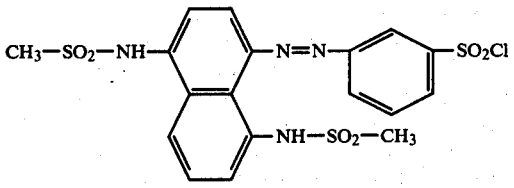

were stirred for 30 minutes in 40 ml of chloroform with the addition of 2 ml of pyridine. 120 ml of methanol were added and stirring was continued for a further 30 minutes. The precipitated dye was suction filtered and washed with methanol.

The residue was heated to boiling in 40 ml of chloroform. 80 ml of methanol were added and the mixture was cooled, suction filtered, washed with methanol and dried.

The yield was 5.2 g of the dye of formula 4.

The dye-sulphochloride of formula D was obtained as follows:

5.5 g of the dye represented by formula E

E

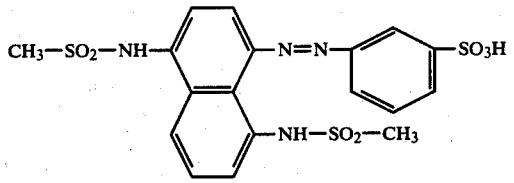

were mixed with 27.5 ml of thionyl chloride. 2.75 ml of dimethylformamide were added dropwise at 20° C. and stirred for one hour at 20° C. until the dye was dissolved. The solution was poured on ince and the precipitate was suction filtered, washed with water until neutral and dried in air.

The yield was 5.2 g of the compound of formula B.

The dye represented by formula E was obtained as follows:

7.6 g of 3-aminobenzenesulphonic acid were dissolved in 120 ml of water under neutral conditions. 12 ml of concentrated hydrochloric acid were then added and a solution of 3 g of sodium nitrite in 12 ml of water was added dropwise at 10° C. The mixture was stirred for a further 15 minutes and excess nitric acid was removed with amidosulphonic acid. 15 g of 1,5-bismethanesulphonamidonaphthalene, prepared by reacting 1 mol of 1,5-diaminonaphthalene with 2 mol of methanesulphonic acid chloride in acetone with the addition of pyridine, were dissolved in 200 ml of water with 7.5 g of sodium hydroxide solution, and the diazotisation solution was added dropwise over a period of one hour at 20° C. The pH was adjusted to 6.5 after 30 minutes' stirring and the solution was then clarified with kieselguhr and left to stand for two days. The dye which had precipitated was suction filtered, washed with 5% sodium chloride solution, stirred up in acetone, again suction filtered, washed with acetone and dried. The yield was 3.3 g of the dye of formula E.

The compounds according to the invention represented by formulae 5 to 11 can be obtained in a similar manner.

The dye-providing compounds according to the invention are incorporated in the casting solutions for the layers of photographic material by one of the usual methods. The quantity of dye-providing compound used per liter of casting solution varies within relatively wide limits, and the most suitable concentration can be found with the aid of simple tests. For example, from 5 to 80 g, preferably from 20 to 40 g, of dye-providing compound may be used per litre of casting solution.

The association between diffusion resistant, dye-providing compound and silver halide necessary for achieving the desired effect can be obtained, for example, by making use of the water-solubilizng groups to introduce the diffusion resistant compounds into the casting solutions from aqueous alkaline solution. Alternatively, the non-diffusible dye-providing compounds may be incorporated in the layers by one of the known emulsification processes. Processes of this kind have been described, for example, in British Patent Specifications Nos. 791,219; 1,099,414; 1,099,415; 1,099,416 and 1,099,417. It is also possible to prepare aqueous dispersions of the dye-providing compounds and add them to the given casting solutions. In that case, aqueous slurries of the dye-providing compound are finely milled, for example by intensive stirring with the addition of sharp edged sand or by using ultrasound. According to another method, it may be desired to incorporate the colour producing compounds in the layer in the form of so-called micro-capsules together with silver halide and optionally also developer substances. In that case, two or more differently sensitized light-sensitive silver halide emulsions and the appropriate diffusion resistant compounds may be combined in a single layer in the form of so-called mixed grain emulsions, for example as described in U.S. Pat. No. 2,698,794. The non-diffusible, dye-providing compounds may be accommodated in a light-sensitive layer or in a layer adjacent thereto. A compound which releases a cyan dye, for example, is associated with the red sensitive layer, a compound releasing a magenta dye with the green sensitive layer and a compound releasing a yellow dye with the blue sensitive layer.

By "association" and "associated" is meant that the silver halide emulsion and the dye-providing compound are so arranged relative to each other that they are capable of interacting with each other to produce an imagewise correspondence between the silver image formed and the imagewise distribution of released diffusible dye. The associated dye-providing compound is preferably incorporated in the silver halide emulsion itself or in a layer adjacent to the silver halide emulsion layer, this adjacent layer being preferably situated behind, viewed in the direction of incident light during exposure, the silver halide emulsion layer. The dye-providing compounds according to the invention are oxidized imagewise by developer oxidation products produced during development of the silver image and then undergo a splitting reaction under the influence of the developer alkali or activator alkali to release the dye residues in a diffusible form, generally as dye sulphonamides. The usual photographic developer compounds are suitable for development, provided that they are capable, when in their oxidized form, of oxidizing the dye-providing compounds according to the invention.

The following are examples of suitable developers:
Hydroquinone,
N-methylaminophenol,
1-phenyl-3-pyrazolidone,
1-phenyl-4,4-dimethyl-3-pyrazolidone,
1-phenyl-4-methyl-4-hydroxymethyl-3-pyrazolidone,
aminophenols,
N,N-diethyl-p-phenylenediamine,
N-ethyl-N-hydroxyethyl-p-phenylenediamine,
3-methyl-N,N-diethyl-p-phenylenediamine,
N,N,N',N'-tetraalkyl-p-phenylenediamines such as tetramethyl-p-phenylenediamine, triethylsulphobutyl-p-phenylenediamine,
1,4-bis-pyrrolidinobenzene, and reductones.

It should be particularly noted that the choice of developer substances in the process according to the invention is not restricted to colour developers but that the usual black-and-white developers may also be used. This is an advantage in view of the lower tendency of the latter to discoloration.

The developers may be contained in the layers of the photographic material, in which they are activated by the alkaline activator liquid, or they may be contained in the alkaline processing liquid or paste. Since the dye-providing compounds according to the invention have developer properties of their own use of auxiliary developer compounds may in some cases be dispensed with. In such cases, the dye-providing compound is directly oxidized by developable silver halide.

If the imagewise distribution of the diffusible dye released during development corresponds with the developed silver image, as is the case with dye-providing compounds of the type described in German Offenlegungsschriften Nos. 2,242,762; 2,505,248; and 1,772,929, the production of positive coloured transfer images requires the use of direct positive silver halide emulsions or, if conventional negative emulsions are used, the application of a suitable reversal process. In the case of the dye-providing compounds described in the last mentioned German Offenlegungsschrift, the diffusible dyes are not released directly as a result of being split by alkali but rather as a result of an intramolecular displacement reaction accompanied by ring closure. Moreover, the released dyes do not have a free sulphonamide group as do the dyes split off from the dye-providing compounds preferably used according to the invention, but a sulphonic acid. However, the invention is by no means restricted to those dye-providing compounds in which splitting is effected by alkali.

A reversal process of this kind is provided in the silver salt diffusion process. Photographic reversal by the silver salt diffusion process to produce positive colour images by means of conventional colour couplers has been described, for example, in U.S. Pat. No. 2,763,800. If the colour couplers are replaced by the dye-providing compounds mentioned above, a light-sensitive element suitable for the dye diffusion transfer process is obtained. Such a light-sensitive element contains, for example, at least one combination of a light sensitive silver halide emulsion layer and a layer of binder associated therewith, containing development nuclei for physical development and a dye-providing compound.

In the development process, the exposed part of the silver halide in the light-sensitive silver halide emulsion layer is chemically developed while the unexposed part is transferred by means of a silver halide solvent to the associated layer of binder which contains development, nuclei, and is physically developed there. If the developer used for physical development is one which in its oxidized form is capable of releasing a diffusible dye as a result of a reaction with the dye-providing compound present in this layer, then diffusible dyes are formed in imagewise distribution and transferred to an image receptor layer where they form a positive colour image.

When reversal is carried out using compounds which split off development inhibitors in imagewise distribution, the light-sensitive element consists of at least one layer combination of a light-sensitive silver halide emulsion layer and a second emulsion layer which contains the dye-providing compound and is developable without exposure. The light-sensitive silver halide emulsion layer is developed for example with colour developers, in the presence of certain compounds which release development inhibitor substances in their reaction with oxidized colour developer. The developer inhibitor substances released imagewise in the light-sensitive layer diffuse into the adjacent emulsion layer which is developable without exposure, and in this layer they inhibit development imagewise. The uninhibited (positive) areas of this emulsion layer which is developable without exposure are thereby developed by the remaining developer, whose oxidation products then react with the non-diffusible dye-providing compounds according to the invention to release diffusible dyes which are transferred imagewise to the image receiving element. Examples of suitable compounds which react with colour developer oxidation products to release development inhibiting substances include the known DIR couplers (DIR=development inhibitor releasing), which are colour couplers which contain a releasable inhibitor group in the coupling position. DIR couplers of this kind have been described, for example, in U.S. Pat. No. 3,227,554.

Another group of compounds which release development inhibitors when they react with oxidation products of colour developers has been described in U.S. Pat. No. 3,632,345. The compounds are not colour couplers and release of the development inhibitors therefore does not give rise to dyes. Lastly, according to German Patent No. 1,229,389, such a process could be carried out using suitably substituted, non-diffusible hydroquinone compounds which are oxidized to the corresponding quinones in their reaction with developer oxidation products and release development inhibiting mercaptans.

Suitable for use as direct positive silver halide emulsions are in principle any direct positive silver halide emulsions which when subjected to simple development give rise to a positive silver image and an imagewise distribution of developer oxidation products corresponding to this image. They include, for example, those silver halide emulsions in which exposure or chemical treatment results in a developable fog which is destroyed imagewise when exposure is carried out under certain conditions. The fog is preserved in the unexposed areas so that subsequent development results in a direct positive silver image and, corresponding thereto, an imagewise distribution of diffusible dye if a dye-providing compound according to the invention is associated with the direct positive silver halide emulsion.

Another group of direct positive silver halide emulsions which are preferred according to the present invention covers the so-called unfogged direct positive silver halide emulsions in which the sensitivity to light is seated predominantly in the interior of the silver halide grains. When these emulsions are exposed imagewise, a latent image is formed predominantly in the interior of the silver halide grains. The development of such unfogged direct positive silver halide emulsions is carried out under fogging conditions so that a fog is produced mainly in the unexposed areas, and development results in a positive silver image. The unfogged direct positive silver halide emulsions are characterised in that when exposed samples are developed with a typical surface developer having the following composition:

p-Hydroxyphenylglycine—10 g
Sodium carbonate (cryst.)—100 g
made up with water to—1000 ml they preferably do not give rise to a silver image or only to one of very low denity whereas when they are developed with an internal nuclear developer having the following composition:

Hydroquinone—15 g
Monomethyl-p-aminophenol sulphate—15 g
Sodium sulphite (anhydrous)—50 g
Potassium bromide—10 g
Sodium hydroxide—25 g
Sodium thiosulphate (cryst.)—20 g
made up with water to—1000 ml a silver image of sufficient density is obtained.

Selective fogging of unfogged direct positive emulsions which have been exposed imagewise may be carried out before or during development, by treating the emulsions with a fogging agent. Reducing agents such as hydrazine or substituted hydrazines are suitable fogging agents for this purpose. Reference may be had to U.S. Pat. No. 3,227,552, for example.

Unfogged direct positive emulsions are, for example, those which have stack faults in the interior of the silver halide grain as described in U.S. Pat. No. 2,592,250, or silver halide emulsions which have a layered grain structure as described in German Offenlegungsschrift No. 2,308,239.

If the dye-providing compounds according to the invention have a non-diffusible, oxidizable carrier residue of the type described in German Offenlegungsschriften Nos. 2,402,900 and 2,543,902, i.e. a carrier residue which is split under alkaline conditions as long as it is in its unoxidized form whereas splitting is difficult or impossible in its oxidized form, the production of positive transfer images does not, of course, require the use of direct positive emulsions or the application of a reversal process but can be achieved with conventional negative emulsions.

The emulsions may be chemically sensitized, for example by the addition of sulphur compounds such as allyl isothiocyanate, allylthiourea or sodium thiosulphate during chemical ripening. Reducing agents may also be used as chemical sensitizers, for example the tin compounds described in Belgian Patent Nos. 493,464 and 568,687; polyamines such as diethylene triamine or aminomethanesulphinic acid derivatives, for example, according to Belgian Patent No. 547,323, may also be used.

Noble metals such as gold, platinum, palladium, iridium, ruthenium and rhodium and compounds of these metals are also suitable chemical sensitizers. This method of chemical sensitization has been described in the article by R. Koslowsky, Z.Wiss.Phot. 46, 65–72 (1951).

The emulsions may also be sensitized with polyalkylene oxide derivatives, e.g. with a polyethylene oxide having a molecular weight of between 1000 and 20,000, or with condensation products of alkylene oxides and aliphatic alcohols, glycols, cyclic dehydration products of hexitols, alkylsubstituted phenols, aliphatic carboxylic acids, aliphatic amines, aliphatic diamines and amides. The condensation products should have a molecular weight of at least 700, preferably more than 1000. These sensitizers may, of course, be used as combinations to achieve special effects, as described in Belgian Patent No. 537,278 and in British Patent No. 727,982.

The emulsions may also be spectrally sensitized, e.g. with the usual monomethine or polymethine dyes such as acid or basic cyanines, hemicyanines, streptocyanines, merocyanines, oxonoles, hemioxonoles, styryl dyes or others, as well as trinuclear or higher nuclear methine dyes, for example rhodacyanines or neocyanines. Sensitizers of this kind have been described, for example, in the work by F. M. Hamer "The Cyanine Dyes and Related Compounds" (1964) Interscience Publishers John Wiley and Sons.

The emulsions may contain the usual stabilizers, e.g. homopolar compounds of salt compounds of mercury having aromatic or heterocyclic rings, such as mercaptotriazoles, or simple mercury salts, sulphonium mercury double salts and other mercury compounds. Azaindenes are also suitable stabilizers, particularly tetra- and penta- azaindenes and especially those which are substituted with hydroxyl or amino groups. Compounds of this type have been described in the article by Birr, Z. Wiss. Phot. 47, 2–27 (1952). Other suitable stabilizers include heterocyclic mercapto compounds, e.g. phenyl mercapto tetrazole, quaternary benzothiazole derivatives and benzotriazoles.

The binder used for the photographic layers is preferably gelatine although this may be partly or completely replaced by other natural or synthetic binders. Examples of natural binders include alginic acid and its derivatives such as its salts, ester or amides, cellulose derivatives such as carboxymethylcellulose, alkylcelluloses such as hydroxyethylcellulose, starch or its derivatives such as ethers or esters, or carrageenates. Polyvinyl alcohols, partially saponified polyvinyl acetate and polyvinyl pyrrolidone are examples of suitable synthetic binders.

The layers may be hardened in the usual manner, for example with formaldehyde or halogen substituted aldehyde containing a carboxyl group, such as mucobromic acid, diketones, methane sulphonic acid ester or dialdehydes.

The light-sensitive element used for carrying out the dye diffusion transfer process according to the present invention contains one or more silver halide emulsion layers and the non-diffusible dye-providing compounds associated therewith, and an image receiving element in which the desired colour image is produced by the diffusible dyes which are transferred to it imagewise. To effect this transfer, firm contact must be established between the light-sensitive element and the image receiving element for at least a finite period of time during development so that the imagewise distribution of diffusible dyes produced in the light-sensitive element as a result of development can be transferred to the image receiving element. This contact may be established either after development has begun or even before the onset of development. The latter method may be employed, for example, in cases where the light-sensitive element and the image receiving element in the material used for carrying out the dye diffusion transfer process form an integral unit, hereinafter referred to as monosheet material, which is preserved even after completion of the development process, i.e. the light-sensitive element is not separated from the image receiving element even after colour transfer. Such an arrangement has been described, for example, in German Offenlegungsschrift No. 2,019,430.

A monosheet material suitable for carrying out the dye diffusion transfer process according to the present invention may comprise, for example, the following layer elements:

(1) a transparent support layer
(2) an image receiving layer
(3) a light impervious layer
(4) a light-sensitive element having at least one light-sensitive silver halide emulsion layer and at least one non-diffusible dye-providing compound associated with this layer,
(5) a retarding layer,
(6) an acid polymer layer,
(7) a transparent support layer The elements of the monosheet material may be so arranged that two different parts are prepared separately from each other, namely the light-sensitive part (layer elements 1 to 4) and the cover sheet (layer elements 5 to 7), these two parts being then placed together with their active surfaces facing each other and bonded together, optionally with the interposition of spacer strips so that a space is left between the two parts for an accurately calculated quantity of processing liquid. The layer elements 5 and 6, which together form the neutralisation system, may also additionally or alternatively be arranged between the substrate layer and the image receiving layer of the light-sensitive part, but in this case their sequence would be reversed.

Means may be provided for introducing a processing liquid between the light-sensitive part and the cover sheet, for example in the form of a rupturable container arranged at the side of the material so that it pours out its contents between two adjacent layers of the monosheet material when subjected to mechanical forces.

An essential part of the photographic material according to the present invention is the light-sensitive element which, in the case of a single-dye transfer process, contains a light-sensitive silver halide emulsion layer and a non-diffusible dye-providing compound associated therewith. The non-diffusible compound may be situated in a layer adjacent to the silver halide emulsion layer or in the silver halide emulsion layer itself. In the latter case, the colour of the image dye is preferably chosen so that the predominant absorption range of the dye-providing compound does not correspond with the predominant sensitivity range of the silver halide emulsion layer.

To produce multicoloured transfer images in true-to-life colours, the light-sensitive element contains three such associations of dye-providing compound with light-sensitive silver halide emulsion layer, and the absorption range of the dye-providing compound as a rule substantially corresponds to the range of spectral sensitivity of the associated silver halide emulsion layer. In that case, in order to obtain the highest possible sensitivity it is necessary that the colour producing combination should be arranged in a separate layer of binder behind, viewed in the direction of incident light during exposure, the silver halide emulsion layer.

The action of the developer oxidation products produced by development of a silver halide emulsion must, of course, be restricted to the associated dye-providing compound. Separating layers are therefore generally provided in the light-sensitive element to prevent diffusion of the developer oxidation products into other layers with which they are not associated. These separating layers may, for example, contain suitable substances which react with the developer oxidation products, for example, non-diffusible hydroquinone derivatives or, if the developer is a colour developer substance, non-diffusible colour couplers. In a preferred arrangement, therefore, the light-sensitive element has the following arrangement of components (from above downwards):

blue sensitive silver halide emulsion layer,
layer containing non-diffusible compound which releases a diffusible yellow dye.
separating layer,
green sensitized silver halide emulsion layer,
layer containing non-diffusible compound which releases a diffusible magenta dye,
separating layer,
red-sensitized silver halide emulsion layer,
layer containing non-diffusible compound which releases a diffusible cyan dye.

The silver halide emulsion layers may, of course, also be arranged in a different sequence, but in that case the associated layers with the dye-providing system must also be interchanged so that the association is preserved.

The light impervious layer arranged under the light-sensitive element is permeable to aqueous alkaline treatment solutions and hence to diffusible dyes. It has two main functions: first, it serves to cover the image silver as well as the dye-providing compounds left behind as colour negative in the originally light-sensitive element after development, so that when the photographic material is viewed through the transparent support layer of the light-sensitive part, only the positive colour transfer image is visible; second, it provides a lightproof cover for the light-sensitive element on the side of the image receiving layer, from the bottom. The latter is particularly important in cases where the monosheet material is brought into contact with the alkaline processing mass while still in the camera after exposure and is then pulled out of the camera to be developed outside.

Layers which are sufficiently impervious to light but sufficiently permeable to diffusible dyes may be prepared, for example, from suspensions of inorganic or organic dark pigments, preferably black pigments, for example suspensions of carbon black, in suitable binders, e.g. in gelatine solutions. To ensure adequate exclusion of light during development, it is generally sufficient to use layers from 0.5 to 2$\mu$ in thickness containing from 10 to 90% by weight, based on the total dry weight, of carbon black in gelatine. The particle size of the pigment used is relatively uncritical, provided that it is not substantially above 0.5$\mu$.

In addition to the black pigment layer, the light impervious layer preferably also includes a white pigment layer arranged underneath it. The purpose of this white pigment layer is to cover the black layer and to provide a white background for the image. Any white pigments are suitable for this layer, provided that it is not necessary to use unduly thick layers to obtain the necessary covering power. Examples of such pigments include barium sulphate, oxides of zinc, titanium, silicon, aluminium and zirconium, barium stearate and kaolin. The white pigment which is preferably used is titanium dioxide. The same conditions apply with regard to the binder, concentration and particle size as for the black pigments. The thickness of the white pigment layer may be varied according to the desired degree of whiteness of the background. Thicknesses of from 5 to 20μ are preferred.

Instead of containing a light impervious layer, the monosheet material according to the present invention may contain means for producing such a layer between the light-sensitive element and the image receiving layer, for example in the form of a container for a liquid containing a clouding agent (pigment) arranged at the side of the monosheet material so that it releases its contents between the above mentioned layers when exposed to mechanical forces to form such a pigment layer between them.

The image receiving layer consists basically of a binder containing dye mordants for fixing the diffusible dyes.

The mordants used for acid dyes are preferably long chain quaternary ammonium or phosphonium compounds or ternary sulphonium compounds, e.g. those described in U.S. Pat. Nos. 3,271,147 and 3,271,148. Certain metal salts and their hydroxides which react with acid dyes to form sparingly soluble compounds may also be used. The dye mordants are dispersed in the receiving layer in one of the usual hydrophilic binders, e.g. in gelatine, polyvinyl pyrrolidone or partially or completely hydrolysed cellulose esters. Some binders may, of course, themselves function as mordants, e.g. copolymers or polymer mixtures of vinyl alcohol and N-vinylpyrrolidone, for example as described in German Auslegeschrift No. 1,130,284, or binders which consist of polymers of quaternary nitrogen bases, e.g. polymers of N-methyl-2-vinylpyridine, for example as described in U.S. Pat. No. 2,484,430. Guanyl hydrazone derivatives of acyl styrene polymers such as those described in German Offenlegungsschrift No. 2,009,498, for example, are also binders which function as mordants. However, the last mentioned mordanting binders would generally be used in combination with other binders, e.g. gelatine.

The usual transparent support materials used in photographic practice may be used as transparent substrate layers for the monosheet material according to the invention, e.g. films of cellulose esters, polyethylene terephthalate, polycarbonates or other film forming polymers.

The alkaline processing substance adjusts the light sensitive material to a relatively high pH (about 11 to 14) which releases development and imagewise dye diffusion. It has been found that the dyes, and hence the images obtained, are not particularly stable at such high pH values. It is therefore necessary to adjust the material to almost neutral or slightly acid after development has been completed. This can be achieved in known manner by providing the material with an additional acid polymer layer which becomes accessible to the alkaline processing substance only gradually during development. By "acid polymer layer" is meant a layer of binder containing polymeric compounds which have acid groups, preferably sulpho or carboxyl groups. These acid groups react with the cations of the processing substance to form salts, thereby lowering the pH of the substance. The polymer compounds and hence the acid groups are, of course, incorporated in a diffusion resistant form in the said layer.

The acid polymers are in many cases derivatives of cellulose or derivatives of polyvinyl compounds, but other polymer compounds may also be used. The following are mentioned as examples of suitable acid polymers: Cellulose derivatives having a free carboxyl group, e.g. cellulose dicarboxylic acid semiesters with a free carboxyl group, such as cellulose acetate hydrogen phthalate; cellulose acetate hydrogen glutarate; ethyl cellulose acetate hydrogen succinate; cellulose acetate hydrogen succinate hydrogen phthalate; ethers and esters of cellulose which have been modified with other dicarboxylic acid anhydrides or with sulphonic acid anhydrides, for example with o-sulphobenzoic acid anhydride; carboxymethylcellulose; polystyrene sulphonic acid; polyvinylhydrogenphthalate; polyvinylacetatehydrogenphthalate; polyacrylic acid; acetals of polyvinyl alcohol with aldehydes which are substituted with carboxyl or sulpho groups, such as o-, m- or p-benzaldehyde sulphonic or carboxylic acid; partially esterified ethylene/maleic acid anhydride copolymers and partially esterified methyl vinyl/maleic acid anhydride copolymers.

The acid polymer layer must contain sufficient acid groups to lower the pH of the processing substance from an initial value of between 11 and 14 so that the material will finally be almost neutral or slightly acid (pH 5 to 8).

The time delay in lowering of the pH is achieved in known manner by coating the acid polymer layer with a so-called retarding layer. This retarding layer is an alkali-permeable layer which preferably consists of a polymer which is inert to alkalies, for example a polyvinyl alcohol or a partially acetalised polyvinyl alcohol.

The amount of delay in lowering of the pH can be adjusted as desired by suitable choice of the thickness and composition of this retarding layer.

A barrier layer containing polymers having a new type of permeability behaviour has been described, for example, in German Offenlegungsschrift No. 2,455,762.

Neutralisation systems, that is to say, combinations of an acid polymer layer and a retarding layer, have been described, for example, in German Patent No. 1,285,310. Layer combinations of this type may be provided in the material according to the invention, for example in the light-sensitive part, between the transparent substrate layer and the image receiving layer.

Another possible arrangement consists of placing the neutralisation system of acid polymer layer and retarding layer on the cover sheet. The two layers must, of course, be arranged in such a sequence that the alkali of the processing substrate must penetrate the retarding layer before it can reach the acid polymer layer.

The dye diffusion transfer process according to the invention may advantageously be carried out in or with a suitable self-developer camera. This camera may be equipped, for example, with devices which allow a processing solution to be distributed between the light-sensitive element and the cover sheet after exposure of the light-sensitive element, this processing solution according to a preferred embodiment additionally serving to shield the light-sensitive material against light from the top. A camera of this kind is preferably equipped with a pair of squeezing rollers between which the monosheet material is pulled out so that the containers arranged at the side of the monosheet material are split open in their passage between the rollers and release their contents between the layers of the monosheet material.

Since the light-sensitive element is protected against unwanted exposure on both sides by light-impervious layers after it has passed between the squeezing rollers, the exposed material may be pulled out of the camera as soon as development has started.

To process the monosheet material after it has been exposed imagewise, the light-sensitive element is brought into contact with the aqueous alkaline processing solution. The silver halide emulsion layers which have been exposed imagewise are thereby developed in the presence of the developer compound, and an imagewise distribution of oxidation products of the developer compound is obtained in correspondence with the positive silver image produced, the said oxidation products of the developer compound oxidizing the associated dye-providing compound, whereupon the dye-providing compound releases the diffusible dye in its reaction with the alkali of the activator.

The aqueous alkaline processing solution may contain viscosity increasing additives, e.g. hydroxyethyl cellulose. It may also contain the usual development accelerators, stabilizers, silver salt solvents, fogging agents or anti-oxidants and other additives.

The dyes according to the invention show significant improvements for use in photographic materials compared, for example, with the dyes disclosed in German Offenlegungsschrift No. 2,607,440 in which no —NR-$^2$—$SO_2$—$R^1$ group is attached to the bicyclic ring in the para-position to the azo group. The advantages are shown both in a shift of the maximum absorption to longer wavelengths and in a greater fastness to light. The absorption is determined after the dye has been fixed to a polyurethane mordant described, for example, in DT-OS 2 631 521 (A-G 1457).

It is found that the cyan dyes corresponding to the dye-providing compounds 1 and 3 according to the invention (without carrier residue) have a maximum absorption $\lambda_{max}$ of 680 nm and 685 nm, respectively. The maximum absorption $\lambda_{max}$ of the magenta dye 4 (without carrier residue) measured on polyurethane mordant is found to be 555 nm.

The lightfastness of the dyes is determined by the known Xeno test. In this test, it is found that compound 1 according to the invention contains a light-fastness value of 2 whereas, for example, the compound disclosed in German Offenlegungsschrift No. 2,406,653 which is represented by the following formula

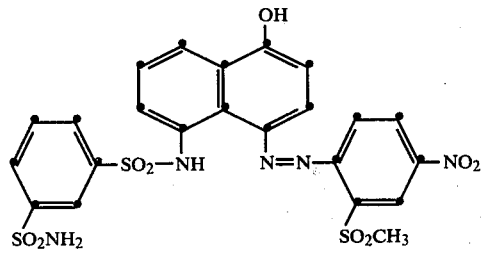

only has a lightfastness value of 1 on polyurethane mordant.

A practical example is described below but the invention is not restricted to it.

Example of application 1

A light sensitive element of a photographic material according to the invention was prepared by applying the following layers in succession to a substrate consisting of a transparent polyester foil. The quantities given are referred in each case to 1 $m^2$.

(1) A mordant layer of 6 g of a polyurethane of 4,4-diphenyldiisocyanate-N-ethyl diethanolamine and epichlorohydrin and 6.0 g of gelatine.
(2) A reflection layer of 24 g of titanium dioxide and 2.4 g of gelatine.
(3) A carbon black layer of 1.9 g of carbon black and 2 g of gelatine.
(4) A dye layer of 0.5 g of compound A (cyan) and 1 g of gelatine.
(5) A red sensitized emulsion layer containing an unfogged direct positive silver chlorobromide emulsion, silver application 2.6 g, gelatine 1.3 g and 40 mg of nucleating agent of formula D.
(6) A barrier layer of 0.5 g of octadecyl hydroquinone sulphonic acid and 1.30 g of gelatine.
(7) A dye layer of 1.0 g of compound B (magenta) and 1.0 g of gelatine.
(8) A green sensitized emulsion layer containing an unfogged direct positive silver chlorobromide emulsion, silver application 2.6 g, gelatine 1.3 g and 40 mg of nucleating agent of formula D.
(9) A barrier layer which is identical to layer 6.
(10) A dye layer of 1.0 g of compound C (yellow) and 1.0 g of gelatine.
(11) A blue sensitized emulsion layer containing an unfogged direct positive silver chlorobromide emulsion, silver application 2.0 g, gelatine 1.3 g and 40 mg of nucleating agent of formula D.
(12) A protective layer of 0.8 g of gelatine and 0.8 g of a carbodiimide instant hardener.
(13) A transparent cover sheet of polyethylene terephthalate with a neutralisation layer and a retarding layer.

After imagewise exposure through a stepped wedge, the light-sensitive element was covered on its active side with the transparent cover sheet. A rupturable container containing an alkaline processing liquid of the following composition was used for developing the light-sensitive element after imagewise exposure:

70 g of potassium hydroxide,
10 ml of benzyl alcohol,
1 g of sodium sulphite,
3 g of benzotriazole,
6.0 g of 1-phenyl-4-methyl-4-hydroxymethyl-3-pyrazolidinone
0.1 g of hydroquinone
30 g of hydroxyethylcellulose
made up to 1000 ml with water.

The film set was passed through a pair of squeezing rollers so that the developer paste was spread out between the light-sensitive element and the cover sheet. The thickness of the layer of paste was 110μ. To adjust this thickness, spacer strips of the appropriate thickness were placed laterally along the edge of the film between the light-sensitive element and the cover sheet.

A direct positive, multicoloured copy of the original was obtained after a development time of 10 minutes.

Example of application 2

A comparison element was prepared by the same procedure as that described above except that compound B in layer 7 was replaced by 0.5 g of compound 4. The direct positive, multicoloured copy of the original obtained after a development time of 10 minutes had distinctly greater colour saturation and colour brilliance than the copy obtained in Example 1.

Annexe of Formulae

A

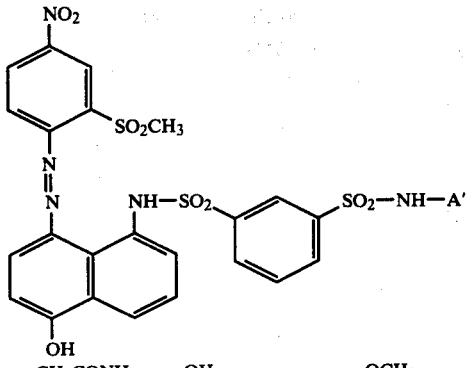

B

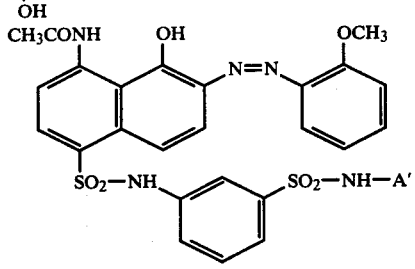

C

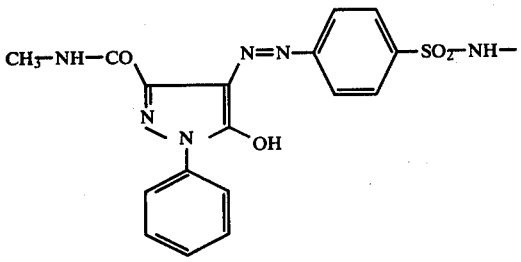

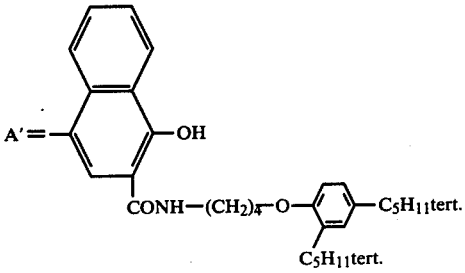

D

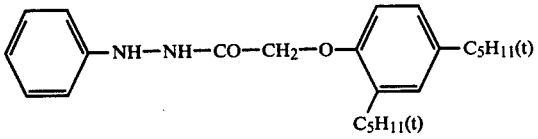

We claim:

1. Photographic dye diffusion transfer process for the production of color images comprising the steps of (a) imagewise exposing a photographic material having at least one light-sensitive silver halide emulsion layer and associated therewith a non-diffusible dye-providing compound (b) developing the material to produce therein metallic silver and developer oxidation products in image distribution (c) oxidizing said non-diffusible dye-providing compound with said developer oxidation products to provide image distributions of oxidized and non-oxidized dye-providing compound (d) releasing under alkaline development condition a diffusible dye either from said oxidized or said non-oxidized dye-providing compound, and (e) transferring the diffusible dye to an image receiving layer to provide an image therein wherein the improvement comprises the non-diffusible dye-providing compound represented by one of the following formulae I to IV:

I

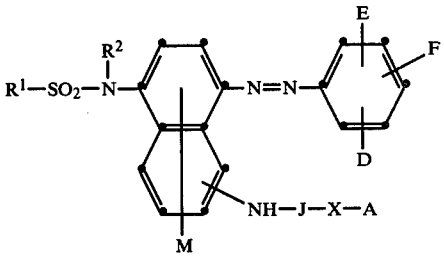

II

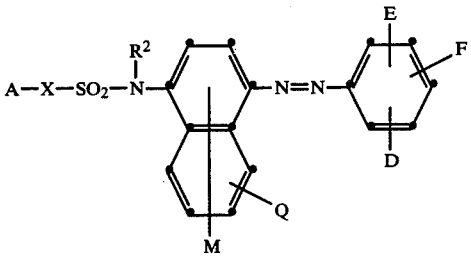

III

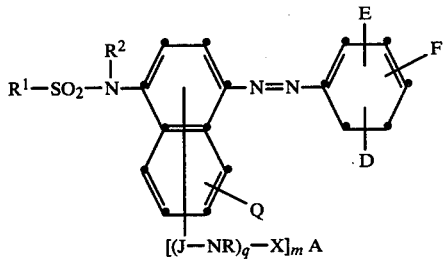

IV

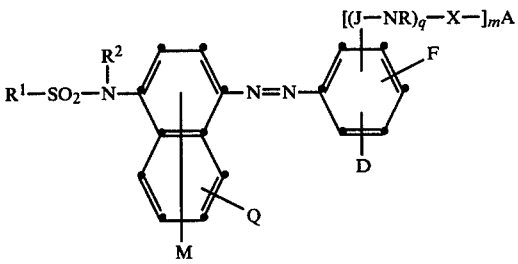

in which

A represents an oxidizable organic carrier residue containing a group which confers diffusion resistance, from which carrier residue either in the oxidized or in the unoxidized form a part thereof together with the group which confers diffusion resistance is split off under the alkaline conditions of photographic development, a diffusible azo dye being released imagewise at the same time;

$R^1$ represents alkyl having from 1 to 6 carbon atoms; or phenyl, which may be substituted by halogen, cyano, alkyl, alkoxy or sulphamoyl;

$R^2$ represents hydrogen or a hydrolysable group having the formula $$-\overset{O}{\overset{\|}{C}}-R^a \text{ or } -\overset{O}{\overset{\|}{C}}-OR^a$$

in which $R^a$ represents an alkyl having from 1 to 18 carbon atoms or a phenyl group;

X represents a bivalent connecting member having the formula $-R^b13\ (Z)_x-(R^b)y$, in which $R^b$ represents an alkylene group having from 1 to 8 carbon atoms or a substituted or unsubstituted phenylene group and the two groups $R^b$ may be the same or different;

Z represents —O—, —CO—, $-CONR^c-$, $-SO_2-$ or —SO— ($R^c$=hydrogen or alkyl);
x=0 or 1,
y=0 or 1, and y=1 when x=1;

R represents a hydrogen atom or an alkyl group having up to 6 carbon atoms;

J represents a sulfonyl or carbonyl group;

m and q each represents 0 or 1;

Q represents an alkoxy group having from 1 to 6 carbon atoms, a hydroxyl group, a group represented by one of the formulae $-NHCOR^d$ or $-NHSO_2R^d$, in which $R^d$ represents an alkyl group having from 1 to 6 carbon atoms, a benzyl or phenyl group, which phenyl group may be substituted and has together with its substituents from 6 to 9 carbon atoms;

M represents a hydrogen atom, a halogen atom, a sulfo or sulfonic acid ester group, cyano, fluorosulfonyl, an alkylsulfinyl group having from 1 to 8 carbon atoms or a phenyl sulfinyl group, or a sulfamoyl group having the formula $SO_2NR^eR^f$ or a carbamoyl group of the formula $-CON(R^{eL})_2$, in which $R^e$ represents hydrogen or an alkyl group having from 1 to 6 carbon atoms and $R^f$ represents a hydrogen atom or an alkyl group having from 1 to 6 carbon atoms, a benzyl group, a phenyl group, a substituted phenyl group having together with its substituents from 6 to 9 carbon atoms, under the condition that the number of carbon atoms of $R^e$ and $R^f$ should not be higher than 14 and $R^e$ and $R^f$ together with the nitrogen atom to which they are attached may form a morpholine or piperidine group; an alkyl carbonyl group, a phenylcarbonyl group, an alkylsulfonyl group having from 1 to 8 carbon atoms or a substituted or unsubstituted phenyl sulphonyl group having from 6 to 9 carbon atoms;

In the case of the cyan dyes,

F represents a nitro group in the 4-position to the azo group;

D represents a halogen atom or a cyano, nitro or trifluoromethyl group or an alkyl group having from 1 to 6 carbon atoms, an alkoxy group having from 1 to 6 carbon atoms, a carboxyl group, a carboxylic acid ester group of the formula $-COOR^g$ (in which $R^g$ represents an alkyl group having from 1 to 18 carbon atoms or a substituted or unsubstituted phenyl group having together with its substituents from 6 to 18 carbon atoms), a fluorosulfonyl or trifluoromethylsulfonyl group, a sulfo or sulfonic acid ester group, a sulfamoyl group of the formula $-SO_2NR^eR^f$ or a carbamoyl group of the formula $-CON(R^e)_2$ in which the groups $R^e$ may be the same or different from each other and have the meaning already specified; an alkylsulphonyl group having from 1 to 8 carbon atoms or a phenylsulphonyl group having together with its substituents from 6 to 9 carbon atoms;

E represents a hydrogen or halogen atom or a nitro, cyano or trifluoromethyl group; and D or $[(J-NR)_q-X-]_mA$ in formula V and E are in the ortho-position to the azo group;

In the case of magenta dyes,

F represents hydrogen, alkyl having from 1 to 4 carbon atoms or alkoxy having from 1 to 4 carbon atoms or halogen; or an electron attracting group selected from the group consisting of cyano, sulfo or a sulfonic acid ester group, fluorosulfonyl group, halogen, alkylsulfonyl group having from 1 to 8 carbon atoms, phenylsulfonyl group having together with its substituents from 6 to 9 carbon atoms, alkylsulfinyl having from 1 to 8 carbon atoms, phenylsulphinyl group having together with its substituents from 6 to 9 carbon atoms, a sulphamoyl group of the formula $SO_2NR^eR^f$ or a carbamoyl group of the formula $-CON(R^e)_2$ in which $R^e$ and $R^f$ have the meanings already specified; D and E which are the same or different, represent hydrogen, cyano, trifluoromethyl, fluorosulfonyl or carboxyl or a carboxylic acid ester group of the formula $-COOR^g$ in the $R^g$ has the meaning already specified, or nitro in the 2- or 3-position to the azo group, fluorine, chlorine or bromine, alkylcarbonyl having from 2 to 7 carbon atoms, phenylcarbonyl having together with its substituents from 7 to 10 carbon atoms, alkyl sulfonyl having from 1 to 8 carbon atoms, phenylsulfonyl having together with its substituents from 6 to 9 carbon atoms, a sulphamoyl group of the formula $SO_2NR^eR^f$ or a carbamoyl group of the formula $-CO-N(R^e)_2$ in which $R^e$ and $R^f$ have the meaning already specified.

2. The process as claimed in claim 1 in which A represents a residue represented by one of the following formulae, which residue is substituted with at least one group which confers diffusion resistance:

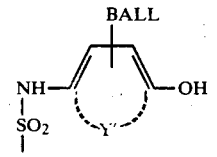

VI

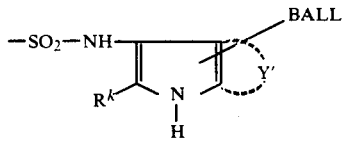

VII

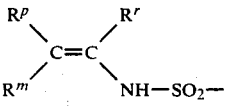

VIII in which formulae,

BALL represents a ballasting group which confers diffusion resistance,

Y' represents a group required for completing a benzene or naphthalene ring,

Y'' represents a group required for completing a condensed, substituted or unsubstituted benzene ring, $R^k$ represents hydrogen, alkyl, aryl, a heterocyclic group, carboxyl, carbamoyl or alkoxycarbonyl;

$R^m$ represents —$OR^n$ or —$NHR^\circ$ wherein $R^n$ represents hydrogen or a group which is hydrolysable under photographic development conditions, and $R^\circ$ represents; hydrogen; alkyl, aryl, or acyl derived from an aliphatic or aromatic carboxylic acid or sulphonic acid;

$R^p$ represents hydrogen, alkyl with up to 22 carbon atoms, aryl, —$NHR^q$ in which $R^q$ represents alkyl, aryl or acyl;

$R^r$ represents hydrogen, alkyl with up to 22 carbon atoms, aryl, cyano, —CO—$NHR^s$ or —CO—$OR^s$ in which $R^s$ represents alkyl or aryl.

* * * * *

UNITED STATES PATENT AND TRADEMARK OFFICE

CERTIFICATE OF CORRECTION

PATENT NO. : 4,171,220

DATED : October 16, 1979

INVENTOR(S) : Vetter et al

It is certified that error appears in the above-identified patent and that said Letters Patent are hereby corrected as shown below:

Column 6, line 24, the complete line must read: "D or $[(J\text{-}NR)_q\text{-}X]_mA$ of formula V and E are in" (delete "13")

Column 10, line 10, the formula for $A^y$ should read:

$A^y$ =

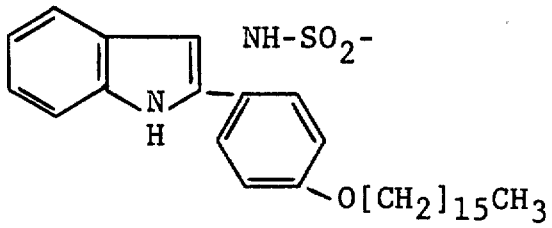

Column 10, line 20, delete "$A^x$" and insert --$A^z$--.

Column 17, line 48, delete "B" and insert --D--.

Column 17, line 56, delete "nitric" and insert --nitrous--.

Column 31, line 9, the formula must read "$R^b\text{-}(Z)_x\text{-}(R^b)_y$" (delete "13").

Column 31, line 34, the formula must read "$\text{-}CON(R^e)_2$" (delete "L").

Signed and Sealed this

Sixth Day of May 1980

[SEAL]

Attest:

SIDNEY A. DIAMOND

Attesting Officer

Commissioner of Patents and Trademarks